US007443368B2

(12) United States Patent
Liao

(10) Patent No.: US 7,443,368 B2
(45) Date of Patent: Oct. 28, 2008

(54) CIRCUIT APPARATUS FOR DRIVING LIGHT EMITTING DIODE WITH LOW VOLTAGE

(75) Inventor: Tai Shan Liao, Taichung (TW)

(73) Assignee: Precision Instrument Development Center, Hsinchu (TW)

( * ) Notice: Subject to any disclaimer, the term of this patent is extended or adjusted under 35 U.S.C. 154(b) by 937 days.

(21) Appl. No.: 10/909,195

(22) Filed: Jul. 29, 2004

(65) Prior Publication Data

US 2005/0140577 A1 Jun. 30, 2005

(30) Foreign Application Priority Data

Dec. 9, 2003 (TW) ..... 92221664 U

(51) Int. Cl.
*G09G 3/321* (2006.01)

(52) U.S. Cl. ..... 345/82

(58) Field of Classification Search ..... 345/82; 315/82, 247
See application file for complete search history.

(56) References Cited

U.S. PATENT DOCUMENTS

| | | | | |
|---|---|---|---|---|
| 5,930,127 | A * | 7/1999 | Iwahori et al. | 363/37 |
| 6,603,342 | B2 | 8/2003 | Liao et al. | 327/487 |
| 2004/0036418 | A1 * | 2/2004 | Rooke et al. | 315/77 |

* cited by examiner

*Primary Examiner*—Richard Hjerpe
*Assistant Examiner*—Shaheda A Abdin
(74) *Attorney, Agent, or Firm*—Haverstock & Owens LLP

(57) ABSTRACT

A circuit apparatus for driving a light emitting diode with a low voltage is disclosed. The circuit apparatus includes an NPN transistor, a PNP transistor, a capacitor connected to a base of the NPN transistor, a resistor connected to a contact point between the base of the NPN transistor and the capacitor and connected to the power, and an inductor connected to the power ground and a collector of the PNP transistor.

5 Claims, 4 Drawing Sheets

CIRCUIT APPARATUS FOR DRIVING LIGHT EMITTING DIODE WITH LOW VOLTAGE

FIELD OF THE INVENTION

This invention relates to a circuit apparatus for driving a light emitting diode (LED), and more particularly to a circuit apparatus provided with a low voltage for obtaining the economic and effective brightness of the LED.

BACKGROUND OF THE INVENTION

Different LEDs are driven by different activating voltages. The activating voltage for driving the LED is dependent on the color of the LEDs, such as the activating voltage for red LED is 2.1 voltage, and the activating voltage for white or blue LED is 3.2 voltage. In other words, it is impossible to use one single battery of 1.5 voltage to drive all LEDs. Therefore, if there is a circuit apparatus being able to drive various LEDs with low voltage, the problem of the different activating voltages for the various LEDs will be solved.

Many low-voltage driving circuit apparatuses containing more than one transistor or integrated circuit component have been developed. The prior art has disclosed one low-voltage circuit apparatus applied on driving LED, and the circuit apparatus contains just two transistors, an inductor and a capacitor (as shown in FIG. 1). The low-voltage circuit apparatus disclosed in this prior art contains the least components and provides the effective circuit apparatus without using the transformer.

Due to the positive pulse voltage driven by the capacitor on the low-voltage circuit apparatus of the prior art, there are some limitations on the brightness of the LED. If the circuit apparatus doesn't change the component numbers, it could not achieve the purpose of driving the LED brighter. In order to achieve the purpose of driving the LED brighter, the present invention changes the direction of the polarity on the circuit components (FIG. 2) and develops a new circuit apparatus (FIG. 3) according to the prior art.

SUMMARY OF THE INVENTION

It is an aspect of the present invention to provide a circuit apparatus for driving the LED with a low voltage.

Another aspect of the present invention is to obtain a better luminosity of LED from generating a negative oscillating voltage according to the concept, which is the sum of the absolute value of the negative value (|A|) and the positive value (B) is larger than one single value on the absolute value of the negative value (|A|) or the positive value (|A|+B>|A| or B).

In accordance with an aspect of the present invention, the high peak voltage of the circuit apparatus is obtained from the sum of the absolute value of the negative pulse voltage provided by the capacitor and the voltage operated by the power supply. The high peak voltage of the circuit apparatus in the present invention is larger than that of the circuit apparatus in the prior art which is obtained from the positive pulse voltage generated from the capacitor.

In accordance with another aspect of the present invention, a circuit apparatus for driving a light emitting diode (LED) and being energized by a power is provided. The circuit apparatus includes a first transistor (NPN transistor), a second transistor (PNP transistor), a capacitor connected to a base of the first transistor, a resistor connected a contact point between the base of the first transistor and the capacitor and connected to the power, and an inductor connected to the power ground and a collector of the second transistor.

Preferably, the first and second transistors are an NPN and a PNP type transistors, respectively.

Preferably, an emitter of the first transistor is connected to the power ground.

Preferably, the inductor is for generating a high negative pulse voltage on a contact point between the collector of the PNP transistor and the inductor by using a low operating voltage.

Preferably, an anode of the LED is connected to the power.

Preferably, a cathode of the LED is connected to a contact point of the collector between the second transistor and connected the inductor.

Preferably, the LED is driven by the circuit apparatus with a low supply voltage plus an absolute value of a negative polarity pulse voltage.

Preferably, a first end of the inductor is connected to the collector of the second transistor, and a second end of the inductor is connected to the power ground.

Preferably, a collector of the first transistor is connected to a base of the second transistor.

Preferably, the collector of the second transistor is connected to a capacitor, and an emitter of the second transistor is connected to the power.

Preferably, the inductor is affected by a self-stimulating oscillation.

Preferably, the negative polarity pulse voltage formed on the contact point between the second transistor and the inductor has the absolute value higher than an activating voltage of the LED.

In accordance with another aspect of the present invention, a circuit apparatus for driving a light emitting diode (LED) and being energized by a power is provided. The circuit apparatus includes a first transistor and a second transistor, a capacitor connected to a base of the first transistor, a resistor connected a contact point between the base of the first transistor and the capacitor and connected the power, and an inductor connected to the power ground and a collector of the second transistor.

Preferably, the first and second transistors are an NPN and a PNP type transistors, respectively.

Preferably, an emitter of the first transistor is connected to the power ground.

Preferably, an anode of the LED is connected to the power.

Preferably, a cathode of the LED is connected to a contact point between the collector of the transistor and the inductor.

Preferably, a first end of the inductor is connected to the collector of the second transistor, and a second end of the inductor is connected to the power ground.

Preferably, a collector of the first transistor is connected to a base of the second transistor.

Preferably, a collector of the second transistor is connected to a capacitor, and an emitter of the second transistor is connected to the power.

In accordance with another aspect of the present invention, a circuit apparatus for driving a light emitting diode (LED) and being energized by a power is provided. The circuit apparatus includes a first transistor (NPN transistor), a second transistor (PNP transistor), a capacitor connected to a base of the first transistor, a resistor connected a contact point between the base of the first transistor and the capacitor and the power, an inductor for using a low operating voltage to generate a high negative pulse voltage on a contact point between the collector of the second transistor and the inductor connected to the power ground and a collector of the second transistor, an anode of the LED connected to the power, a cathode of the LED connected to a contact point of the collector of the second transistor and the inductor, an emitter of the first transistor connected to a power ground, a collector of the first transistor connected to a base of the second transistor, a first end of the inductor connected to the collector of the second transistor, and a second end of the inductor connected to the power ground, a capacitor connected to the collector of the second transistor, and an emitter of the second transistor connected to the power, wherein the negative polarity pulse voltage formed on the contact point between the second transistor and the inductor has the absolute value higher than an activating voltage of the LED.

The above objects and advantages of the present invention will become more readily apparent to those ordinarily skilled in the art after reviewing the following detailed descriptions and accompanying drawings, in which:

DETAILED DESCRIPTION OF THE PREFERRED EMBODIMENT

The invention will now be described more specifically with reference to the following embodiments. It is to be noted that the following descriptions of preferred embodiments of this invention are presented herein for the purpose of illustration and description only; it is not intended to be exhaustive or to be limited to the precise form disclosed.

Figure 1:
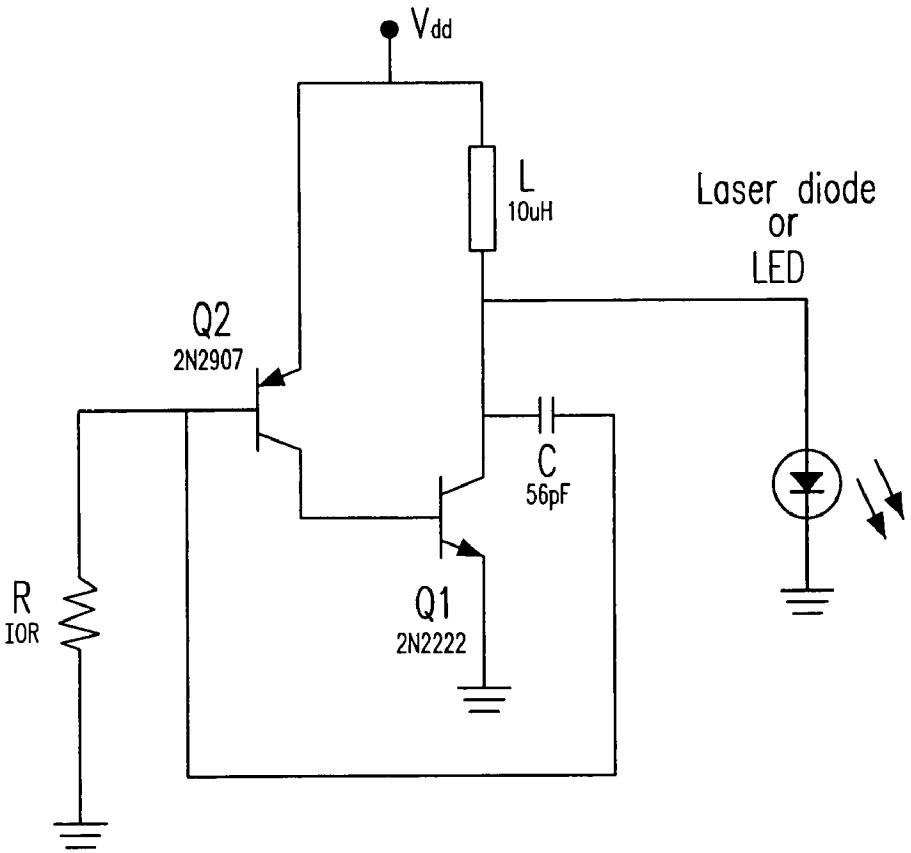
Fig. 1 (PRIOR ART)
FIG. 1 is the circuit apparatus for driving the LED with a low voltage according to the prior art.
Figure 2:
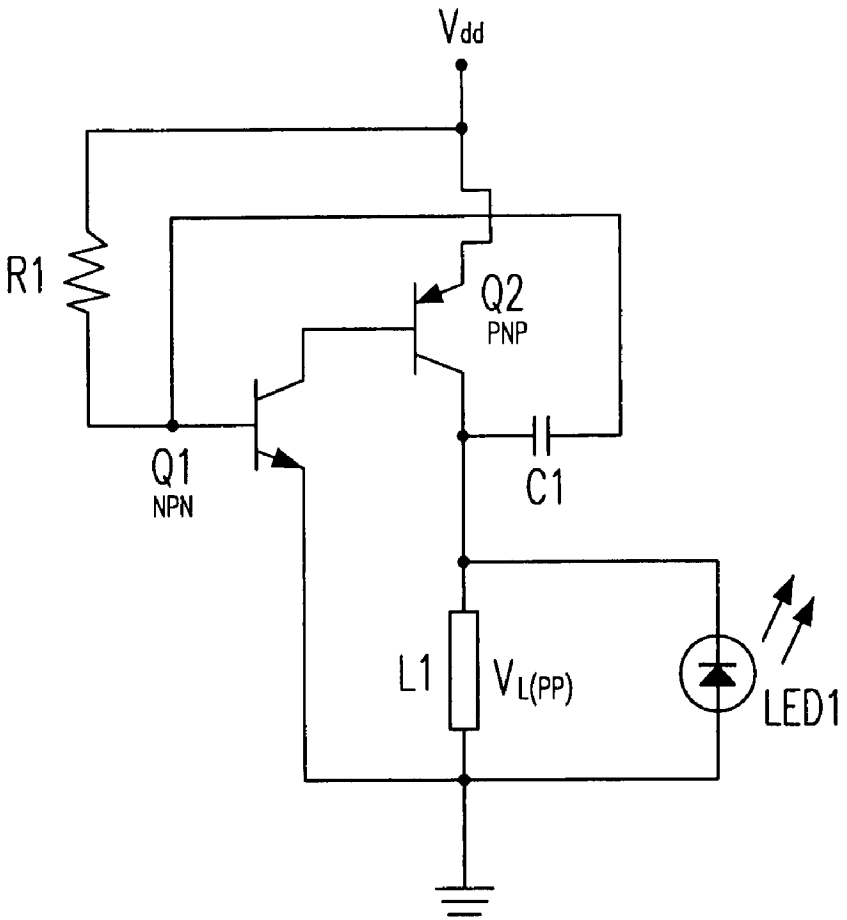
Fig. 2(PRIOR ART)
FIG. 2 is the circuit apparatus with the components having the opposite directions and the opposite polarity arrangements to those in the prior art.
Figure 3:
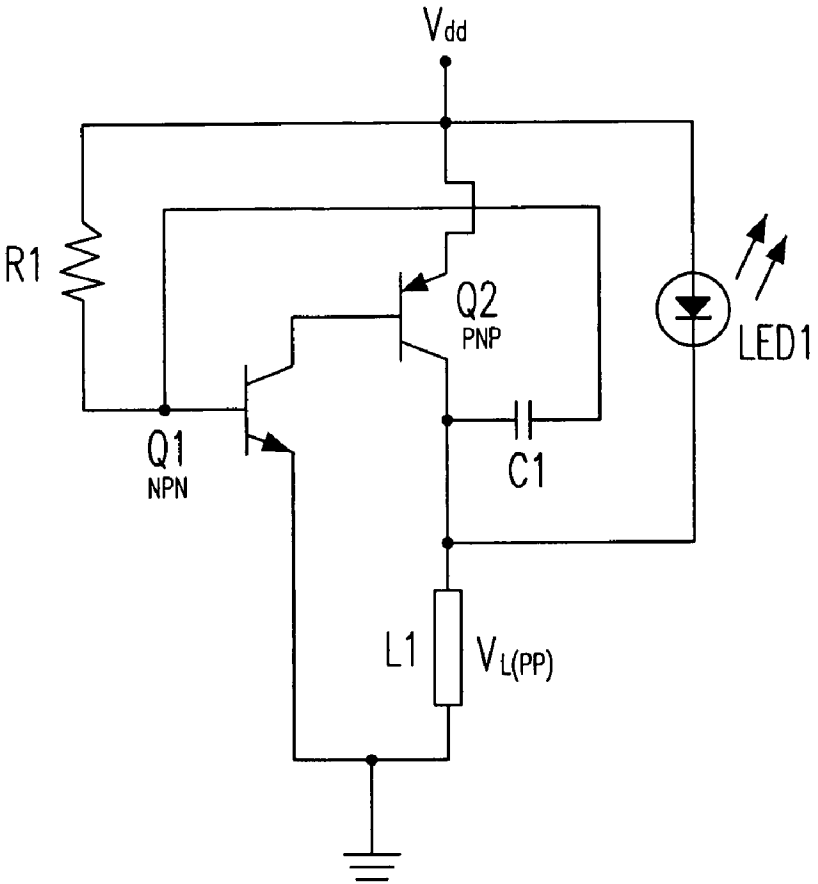
FIG. 3 is a schematic view showing the circuit apparatus for driving LED after combining the oscillating voltage generated from the low voltage with the voltage operated from the power supply according to the preferred embodiment of the present invention.

Please refer to FIG. 3 showing a circuit apparatus for driving a LED according to the preferred embodiment of the present invention. The circuit apparatus providing the oscillating voltage generated from the low voltage and the voltage operated from the power supply is constructed by a first and a second transistors Q1 and Q2, a resistor R1, an inductor L1, and a capacitor C1.

Figure 4:
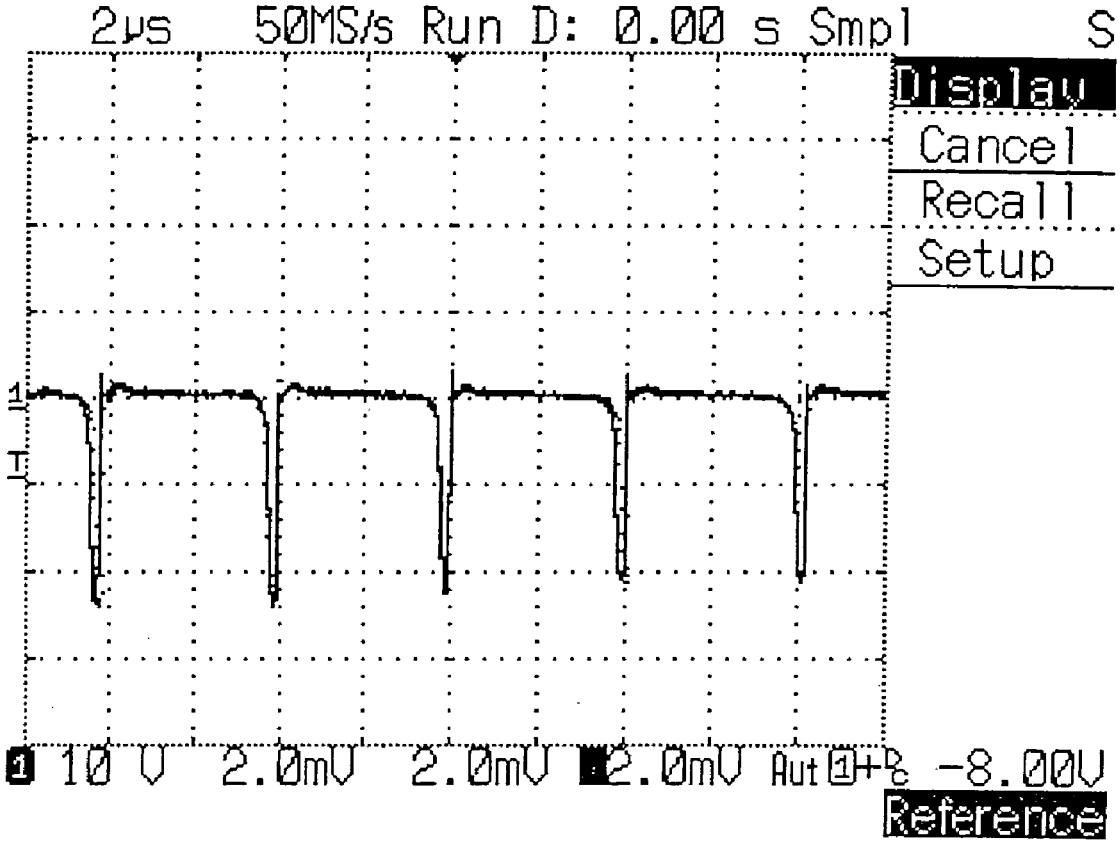
FIG. 4 is the graph of wave pattern provided from the circuit apparatus for driving LED according to the present invention after combining the oscillating voltage generated from the low voltage with the voltage operated from the power supply.

According to the present invention, FIG. 3 shows that a collector of the first transistor (NPN transistor) Q1 connected to a base of a second transistor (PNP transistor) Q2 and the collector of the second transistor Q2 connected between the base of the first transistor Q1 and a capacitor C1. The resistor R1 for adjusting voltage is connected the contact point of the base of the first transistor Q1 and capacitor C1 and the power Vdd. The emitter of the second transistor Q2 is connected to the power Vdd. The emitter of the first transistor Q1 is connected to the power ground. A first end of the inductor L1 is connected to the collector of the second transistor Q2, and a second end of the inductor L1 is connected to the power ground. The inductor L1 affected by self-oscillating on the circuit apparatus can process a high negative pulse voltage on the contact point between the collector of the second transistor Q2 and the inductor L1 by a very low operation voltage, as shown in FIG. 4. The absolute value of the voltage is higher than the driving voltage of the LED.

Further, an anode of the LED is connected to the power Vdd and a cathode of the LED is connected to a contact point of the collector between the second transistor Q2 and the inductor L1. The voltage of the power voltage and the absolute value of the negative pulse are added together for driving the LED on the circuit apparatus. When the white LED is driven by the circuit apparatus according to the present invention, the peak of white light spectrum on 418 nm is up at least 20% than that of the circuit apparatus according to the prior art.

In conclusion, the present invention provides a circuit apparatus for driving LED after combining the oscillating voltage generated from the low voltage with the voltage operated from the power supply. The circuit apparatus increases the range of dynamic operating voltage.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A circuit apparatus for driving a light emitting diode (LED) and being energized by a power source, comprising:

a first transistor;

a second transistor;

a capacitor connected to a base of said first transistor and to a collector of said second transistor;

a resistor connected to a contact point between said base of said first transistor and said capacitor and connected to said power source;

an inductor for using said power source with a low supply voltage to generate a high negative pulse voltage on a contact point between said collector of said second transistor and said inductor connected to a power ground and said collector of said second transistor;

an anode of said LED connected to said power source;

a cathode of said LED connected to a contact point of said collector of said second transistor and said inductor;

an emitter of said first transistor connected to said power ground;

a collector of said first transistor connected to a base of said second transistor;

a first end of said inductor connected to said collector of said second transistor, and a second end of said inductor connected to said power ground; and an emitter of said second transistor connected to said power source, wherein said negative pulse voltage formed on a contact point between said second transistor and said inductor has an absolute value higher than an activating voltage of said LED.

2. The circuit apparatus as claimed in claim 1, wherein said first and second transistors are an NPN and a PNP type transistors, respectively.

3. The circuit apparatus as claimed in claim 1, wherein said LED is driven by said circuit apparatus with said low supply voltage plus said absolute value of said negative pulse voltage.

4. The circuit apparatus as claimed in claim 1, wherein said inductor is affected by a self-stimulating oscillation.

5. A circuit apparatus for driving a light emitting diode (LED) and being energized by a power source, comprising:

an NPN transistor;

a PNP transistor;

a capacitor connected to a base of said NPN transistor and to a collector of said PNP transistor;

a resistor connected to a contact point between said base of said NPN transistor and said capacitor and said power source;

an inductor for using said power source with a low operating voltage to generate a high negative pulse voltage on a contact point between said collector of said PNP transistor and said inductor connected to a power ground and said collector of said PNP transistor;

an anode of said LED connected to said power source;

a cathode of said LED connected to a contact point of said collector of said PNP transistor and said inductor;

an emitter of said NPN transistor connected to said power ground;

a collector of said NPN transistor connected to a base of said PNP transistor;

a first end of said inductor connected to said collector of said PNP transistor, and a second end of said inductor connected to said power ground; and an emitter of said PNP transistor connected to said power source, wherein said negative pulse voltage formed on a contact point between said PNP transistor and said inductor has an absolute value higher than an activating voltage of said LED.

* * * * *